United States Patent [19]

Hasegawa et al.

[11] Patent Number: 5,077,453

[45] Date of Patent: Dec. 31, 1991

[54] ARC-EXTINGUISHER OF A SWITCH

[75] Inventors: Hiroshi Hasegawa; Junichiro Nishitani; Toshimasa Maruyama, all of Marugame, Japan

[73] Assignee: Mitsubishi Denki Kabushiki Kaisha, Tokyo, Japan

[21] Appl. No.: 614,027

[22] Filed: Nov. 16, 1990

Related U.S. Application Data

[63] Continuation of Ser. No. 252,937, Oct. 4, 1988, abandoned.

[30] Foreign Application Priority Data

Oct. 5, 1987 [JP] Japan ..... 62-251931
Oct. 5, 1987 [JP] Japan ..... 62-251932
Oct. 5, 1987 [JP] Japan ..... 62-251942

[51] Int. Cl.[5] ..... H01H 33/70

[52] U.S. Cl. ..... 200/148 B; 200/148 A; 200/148 R

[58] Field of Search ..... 200/147 R, 148 R, 148 A, 200/148 B, 150 G

[56] References Cited

U.S. PATENT DOCUMENTS 4,041,263 8/1977 Noeske ..... 200/147 R
4,268,733 5/1981 Garzon ..... 200/148 A
4,303,814 12/1981 Scheibe ..... 200/148 A
4,445,018 4/1984 Holmgren ..... 200/148 A
4,459,447 7/1984 Arimoto ..... 200/148 A

FOREIGN PATENT DOCUMENTS 3615559 1/1987 Fed. Rep. of Germany .
1145609 3/1956 France .
1371514 10/1963 France .
2266285 10/1975 France .
55-17924 2/1980 Japan .
55-48520 11/1980 Japan .

*Primary Examiner*—J. R. Scott
*Attorney, Agent, or Firm*—Burns, Doane, Swecker & Mathis

[57] ABSTRACT

An insulative tube (93) of a switch is molded with an inserted tubular condutor (15), and a sliding contact (14) provided on outer surface of a piston (7) slides on an inner surface of the tubular conductor (15); the insulative tube (3) is thereby reinforced against the pressure of an insulation gas sealed in the insulative tube (3). The piston (7) and the tubular conductor (15) are electrically connected in a stable manner and undesirable tottering of moving contacts (8), (16) mounted on the piston (7) can be prevented.

4 Claims, 7 Drawing Sheets

ARC-EXTINGUISHER OF A SWITCH

This application is a continuation of application Ser. No. 07/252,937, filed Oct. 4, 1988, now abandoned.

FIELD OF THE INVENTION AND RELATED ART STATEMENT

1. Field of the Invention

The present invention relates to an arc-extinguisher of a switch, and especially relates to an improvement of an arc-extinguisher of a puffer-type gas switch for opening and closing an electric circuit.

2. Description of the Related Art

A conventional arc-extinguisher of a puffer-type gas switch which is, for example, shown in published unexamined Japanese Utility model application Sho 59-88842 is described in reference to FIG. 8. FIG. 8 is a cross-sectional view showing an arc-extinguisher of a conventional puffer-type gas switch in an open state of the contacts thereof.

A lower tank 101 is fixed on a bottom flange 102. The lower tank 101 generally contains driving shafts (not shown) of three-phases which are connected to an operation mechanism and levers which connect the driving shafts and insulative rods 105 of the respective three-phases. As the above-mentioned constitution is generally known, the driving shafts, levers and operation mechanism are not shown in the figures for simplicity. An insulative tube 103 contains elements 104 for arc-extinction and is filled with insulation gas such as $SF_6$. The insulative tube 103 has a double casing of inner arc-proof material 103*a* and outer normal material 103*b*. An end of an insulative rod 105, which is connected to the driving lever (not shown in the figure) in the lower tank 101, is connected to an end of a conductive piston rod 106 which is reciprocatively driven in directions shown by arrows A and B. On the other end of the piston rod 106, a disc-shaped piston 107 and a moving contact 108 are fixed. The piston 107 closely slides on an inner surface 103C of the insulative tube 103, and thereby the piston 107 compresses and expands the insulation gas in a lower space 109 and an upper space 110. An insulative nozzle 111 is fixed on the piston 107 co-axially with the moving contact 108 by a nozzle joiner 112. A fixed contact 113 to be connected to the moving contact 108 is fixed on an upper cover 115. When the moving contact 108 is in contact with the fixed contact 113, the electric circuit whereto the switch is provided is closed. A midway position of the moving contact 108 contacts a sliding contact 114, and thereby an electric current flows from the sliding contact 114 to the moving contact 108 and vice versa.

Operation of the above-mentioned conventional switch is described in the following.

When a closing command is issued from a control apparatus (not shown in the figure), the insulative rod 105 is linearly driven by the operation mechanism. In the closing operation of the contacts 108 and 113, the insulative rod 105 is pushed up in a direction shown by arrow A. When such action continues, the moving contact 108 and the fixed contact 113 are closed at a position near to the final position of the closing operation. For opening the contacts 108 and 113, the reverse action to the above-mentioned may be carried out.

In the above-mentioned conventional arc-extinguisher of the switch, electric current is capable of flowing when the moving contact 108 and the fixed contact 113 contact each other, and the actual path of electric current is from the sliding contact 114 to the piston rod 106. Since the capacity of the current of the switch is governed by that of the sliding contact 1147, the capacity of current of the conventional switch could not be increased. In order to increase the capacity of the switch, it is necessary to form another path for current. The conventional switch has a disadvantage that the constitution becomes complex when such another path is made.

Furthermore, when the piston rod 106 is eccentrically driven, pressure is not applied uniformly to the sliding contact 114. Accordingly, when a large current such as shortcircuited current flows, arcing occurs at a portion where the contact pressure is relatively light. Still more, when the arcing occurs between the moving contact 108 and the fixed contact 113, the material of the contacts 108 and 113 is melted down and powder of the melted material adheres to the sliding contact 114. As a result, an imperfect contact between the sliding contact 114 and the piston rod 108 occurs and sliding friction of them increases. Therefore, such phenomena cause malfunction of the switch.

On the other hand, the pressure vessel of the above-mentioned conventional switch is filled by an insulation gas normally having pressure of 2–5 $kgf/cm^2$. The pressure of the insulation gas builds up 10–20 $kgf/cm^2$ when the electric current is cut off. Therefore, the thickness of the insulative tube 103 is sufficiently thick for with standing such a high pressure. And also, when the insulative tube 103 is made as a double casing and the inner part 103*a* is made of an arc-proof insulative material, it is difficult to make the insulative tube 103 thin because mechanical strength of the insulative material against pressure becomes relatively low.

OBJECT AND SUMMARY OF THE INVENTION

An object of the present invention is to provide an improved arc-extinguisher of a switch having large current capacity with a simple constitution.

An arc-extinguisher of a switch in accordance with the present invention comprises:

a rod shaped fixed contact;

a tubular moving contact arranged coaxially with the fixed contact and held to make axial movement to and from the fixed contact;

a piston whereon the moving contact is mounted and reciprocally moving to drive the moving contact to make the axial movement;

a cylindrical sliding contact provided on an outer peripheral part of the piston; and a cylinder having an inner conductive surface whereon the sliding contact slides with electric connection therebetween and forming a compressing space together with the piston, the length of the inner conductive surface in moving direction of piston being longer than the stroke of the sliding contact.

As mentioned above, in the present invention, the sliding contact is provided on a large diameter part of external surface of the piston, so that a switch having large capacity can be provided with simple configuration.

DESCRIPTION OF THE PREFERRED EMBODIMENTS

Figure 1:
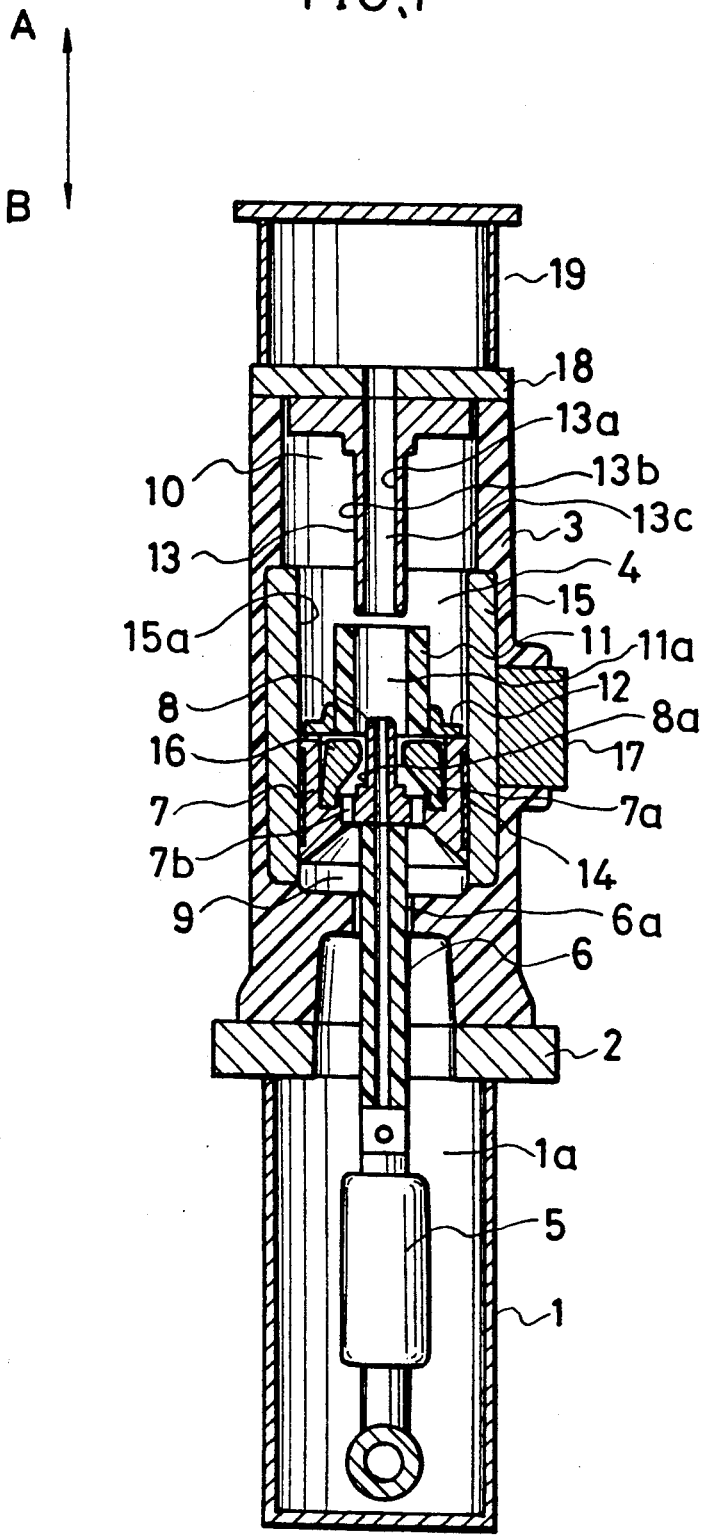
FIG. 1 is a cross-sectional view showing a preferred embodiment of an arc-extinguisher and a pressure vessel of a switch in accordance with the present invention wherein contacts are opened.
Figure 2:
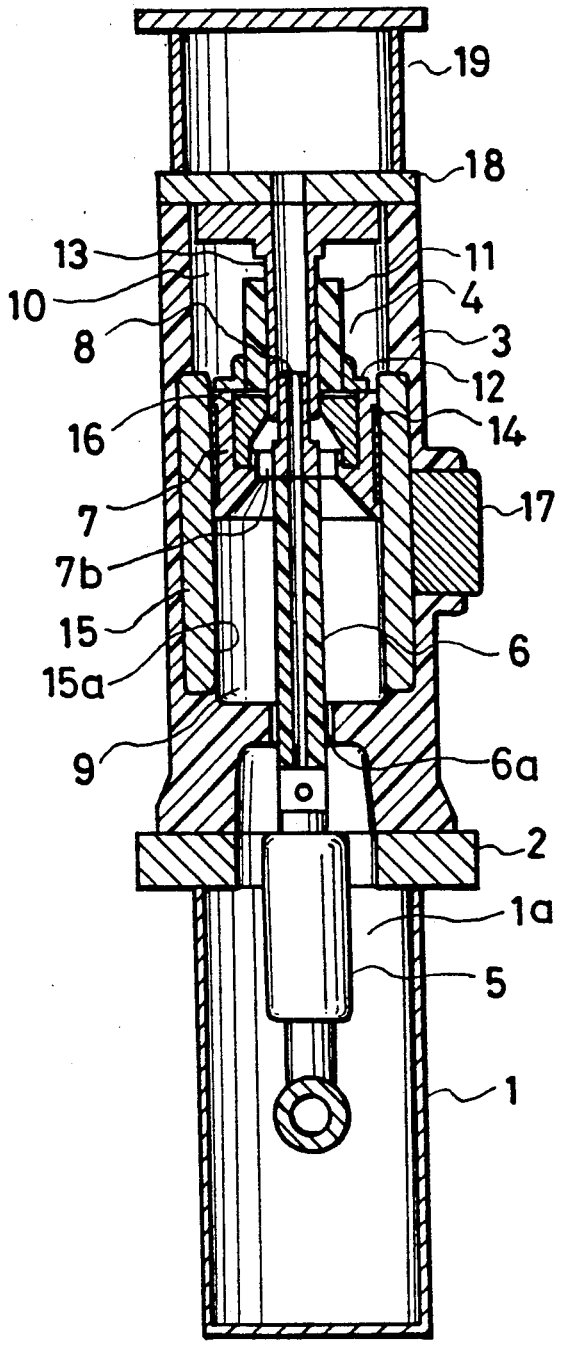
FIG. 2 is a cross-sectional view showing the arc-extinguisher and the pressure vessel of FIG. 1 wherein the contacts are closed.
Figure 3:
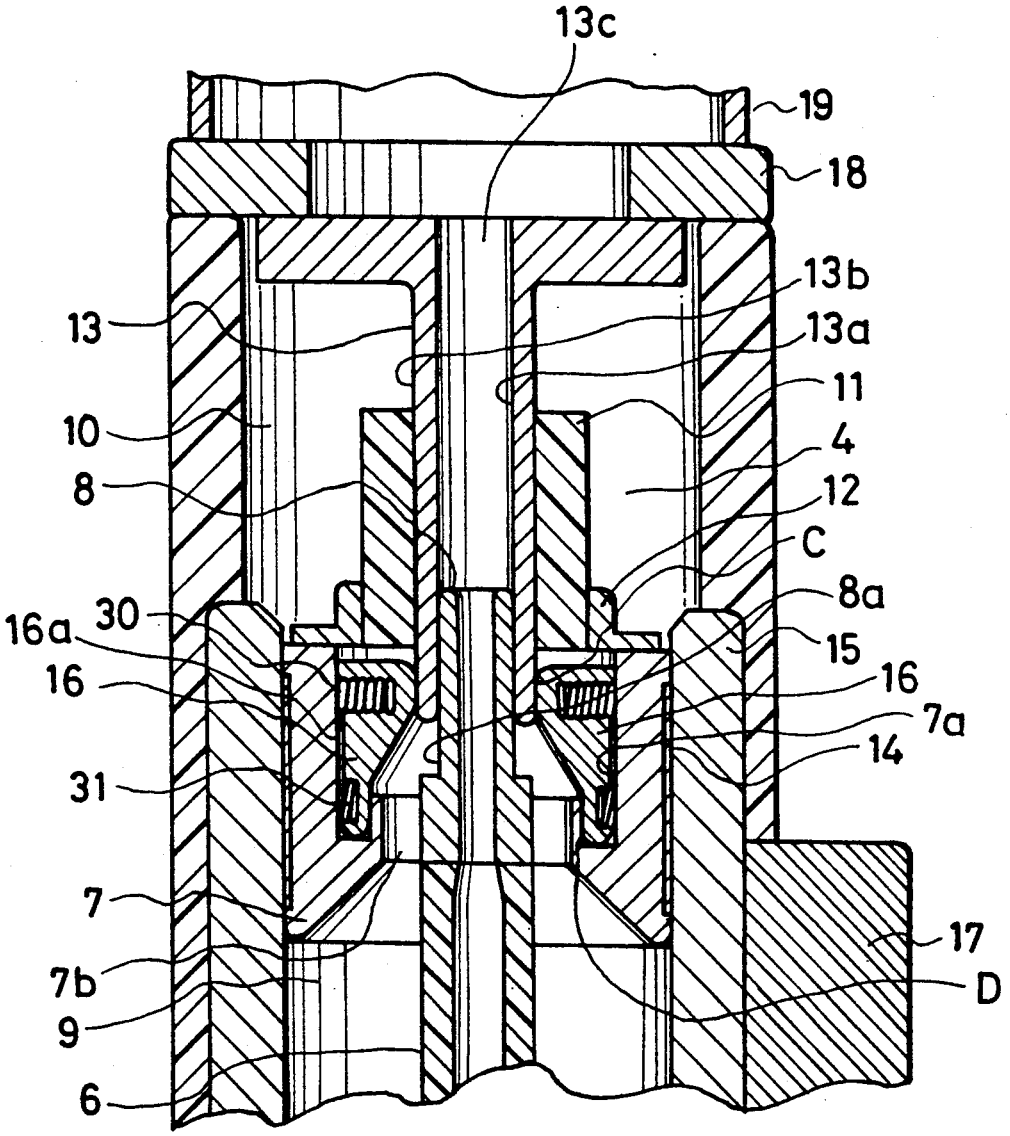
FIG. 3 is a cross-sectional view showing details of the arc-extinguisher and the pressure vessel of FIG. 2.

A first preferred embodiment of an arc-extinguisher and a pressure vessel of a switch in accordance with the present invention is described making reference to FIG. 1, FIG. 2 and FIG. 3. FIG. 1 is a cross-sectional view showing the arc-extinguisher and the pressure vessel under a condition that the contacts are opened. FIG. 2 is a cross-sectional view showing the arc-extinguisher and the pressure vessel shown in FIG. 1 under a condition that the contacts are closed. FIG. 3 is an enlarged cross-sectional view showing details of the arc-extinguisher and the pressure vessel of FIG. 2.

In the figures, a lower tank 1 is fixed on a bottom flange 2 and contains driving shafts of each of three phases driven by an operation mechanism and insulative rods which are connected to the driving shafts. As the driving shafts and the operation mechanism are known in the art, they are not shown in the figure for simplifying the drawings. Furthermore, only one insulative rod 5 is shown in the figure. An insulative tube 3 contains arc-extinction elements 4 and is filled with insulation gas such as $SF_6$. The arc-extinction elements 4 consist of, for example, an insulation rod 5, a conductor, a conductive piston rod 6, a cylindrical piston 7 and a moving arc-contact 8. The insulative rod 5 is not connected to the driving lever. The conductive piston rod 6 is reciprocatively driven in directions shown by arrows A and B and connected to an end of the insulative rod 5. The cylindrical piston 7 and a moving arc-contact 8 are fixed to the other end of the piston rod 6.

The insulative tube 3 is molded with a tubular conductor 15. The piston 7 and a sliding contact 14 which is co-axially provided on outer surface of the piston 7 slide on an inner surface 15*a* of the tubular conductor 15. The insulation gas in a lower space 9 and an upper space 10 is expanded and compressed by the motion of the piston 7. An insulative nozzle 11 is fixed on the piston 7 coaxially with the moving arc-contact 8 by a nozzle joiner 12. A fixed contact 13 to be connected to the moving arc-contact 8 and having tubular shape is fixed on an upper terminal 18. When an outer surface 8*a* of the moving arc-contact 8 is in contact with inner surface 13*a* of the fixed contact 13, an electric circuit, which is to be connected to the switch, is closed. Plural current collectors 16 are circularly provided in the cylindrical piston 7 around the moving contact 8. When the moving contact 8 is in contact with the fixed contact 13, the current collectors 16 are also in contact with an external surface 13*b* of the fixed contact 13. The current collectors 16 serve as a main moving contact. A lower terminal 17 is electrically in contact with the tubular conductor 15 and provided at midway position of the insulative tube 3. An upper tank 19 is fixed on the upper terminal 18 and thereby the insulation gas such as $SF_6$ is sealed in the insulative tube 3.

As shown in FIG. 3, two compression springs 30 and 31 are provided between an inner surface 7*a* of the piston 7 and an outer surface 16*a* of each current collector 16 so as to apply contact pressures at positions C and D.

In a switch which is constituted as mentioned above, when the contacts 8 and 13 contact each other, the electric current flows in the following order from the upper terminal 18, through the fixed contact 13, the current collector 16 which serves as a main moving contact, the piston 7, the sliding contact 14, the tubular conductor 15 to the bottom terminal 17. When a trip signal is issued (1 for example, by flow of an accidental over-current), movable elements of the arc-extinction elements 4 such as the piston 7, the moving arc-contact 8, the current collectors 16 and so on are driven in a direction shown by arrow B by action of the operation mechanism (not shown in the figure because of being known in the art). When the piston 7 moves in the direction shown by arrow B, the insulation gas in the lower space 9 is compressed and the insulation gas in the upper space 10 is expanded. Then, the current collector 16 departs the fixed contact 13 according to movement of the movable element of the arc-extinction elements 4 in the direction shown by arrow B. Also, when the moving arc-contact 8 departs from the fixed contact 13, an arc is discharged. By such actions, the pressure of the insulation gas in the lower space 9 becomes higher than those of the gases in other spaces.

When pressure buildup due to the arc discharge is above approximately the zero point of the current, the insulation gas in the bottom space 9, where the pressure of the insulation gases is high, flows to other space where the pressures are lower than that in the bottom space 9. For example, a gas passing through a hole 7*b* of the piston 7 flows through a hole 11*a* of the nozzle 11 and a hole 13*c* of the fixed contact 13 to the upper space 10 and the upper tank 19, and another gas passing through a gap 6*a* between the insulative tube 3 and the piston rod 6 flows to an inner space 1*a* of the bottom tank 1.

At that time, the insulation gas flowing from the bottom space 9 to the upper space 10 collides with an arc made by discharge between the fixed contact 13 and the moving arc-contact 8. Accordingly, the arc is cooled and diffused by the flow of the insulation gas, and finally the arc is extinguished. When the arc is extinguished, the switching off of the circuit is completed. In an operation for closing the switch, the movable elements of the arc-extinction elements 4 move in a reverse direction shown by arrow A, and the switch is closed by contact of the current collectors 16 (which serve as a main moving contact) and the fixed contact 13.

Figure 4:
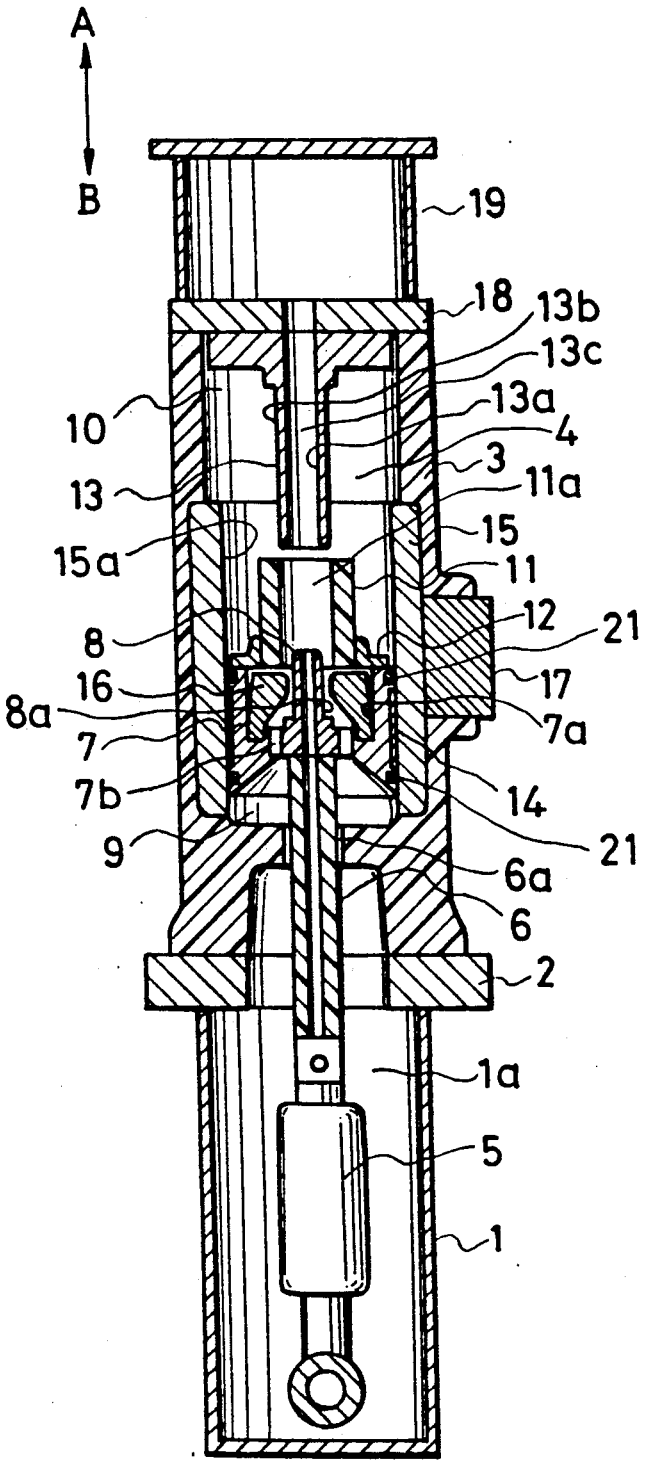
FIG. 4 is a cross-sectional view showing another preferred embodiment of an arc-extinguisher and a pressure vessel of a switch in accordance with the present invention wherein contacts are opened.
Figure 5:
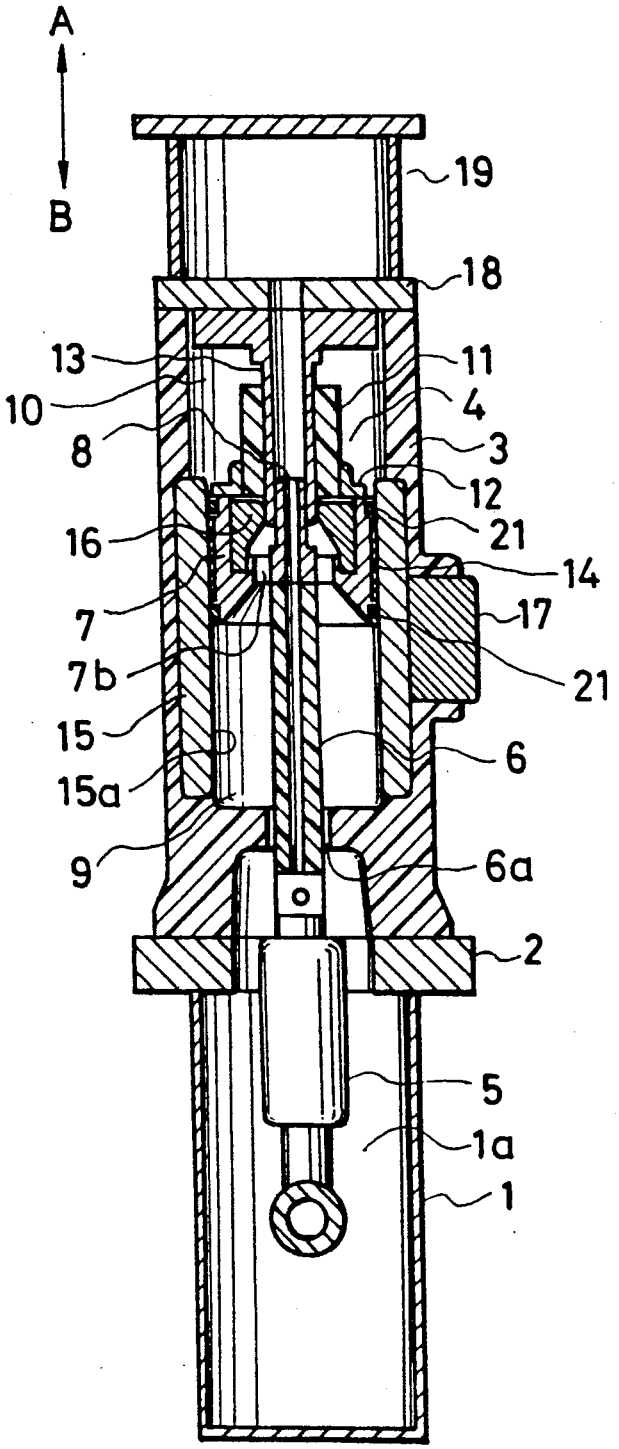
FIG. 5 is a cross-sectional view showing the arc-extinguisher and the pressure vessel of FIG. 4 wherein the contacts are closed.
Figure 6:
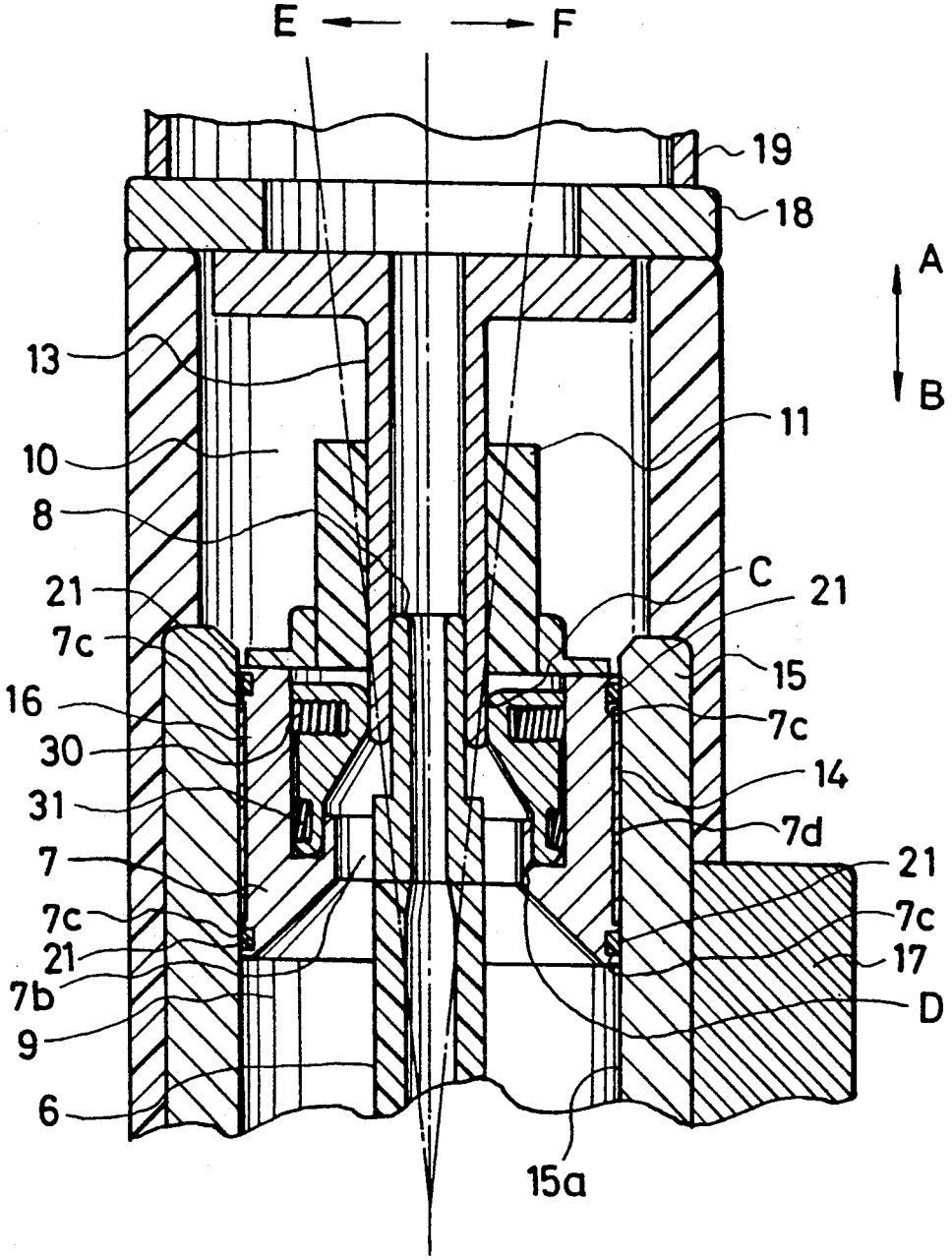
FIG. 6 is a cross-sectional view showing details of the arc-extinguisher and the pressure vessel of FIG. 5.

A second preferred embodiment of an arc-extinguisher and a pressure vessel of a switch in accordance with the present invention is described making reference to FIG. 4, FIG. 5 and FIG. 6. FIG. 4 is a cross-sectional view showing the arc-extinguisher and the pressure vessel of the second embodiment under a condition that contacts of the switch are opened. FIG. 5 is a cross-sectional view showing the arc-extinguisher and the pressure vessel shown in FIG. 4 under a condition that the contacts are closed. FIG. 6 is an enlarged cross-sectional view showing details of the arc-extinguisher and the pressure vessel of FIG. 5. Elements indicated by numerals 1 to 19 respectively designate the same or similar parts and components to those designated by the same numerals in FIGS. 1 to 3, and detailed description of the elements 1 to 19 is omitted.

In the figures, two piston rings 21, which are made of low friction elastic material, for example polytetrafluoroethylen, and have rectangular sections, are provided in circular grooves 7*c* of the piston 7. The circular grooves 7C are respectively formed on a cylindrical outer surface 7*d* of the piston 7, at positions above and below the sliding contact 14 and nearby both end parts of the piston 7 in axial direction thereof. The outer surfaces of the piston rings 21 closely adhere to the inner surface 15*a* of the tubular conductor 15, and thereby the piston 7 smoothly slides on the inner surface 15*a* of the tubular conductor 15 with a low friction coefficient.

In the second embodiment, a gap between the piston 7 and the tubular conductor 15 is stopped by the piston rings 21, so that the inner space of the insulative tube 3 is hermetically divided in two parts of the lower space 9 and the upper space 10. Therefore, when the piston 7 comes down in the direction shown by arrow B, the insulation gas in the lower space 9 flows through the hole 7*b* of the piston 7 to the upper space 10. At this time, the arc induced between the fixed contact 13 and the moving arc-contact 8 is cooled and diffused by the flow of the insulation gas. As a result, the arc is extinguished and the current of the switch is cut off.

In the above-mentioned arc-extinction process, particles of chemical compounds of the melted material of the nozzle 11, the fixed contact 13 and the moving arc-contact 8 and the insulation gas are produced by chemical reaction. However, the particles do not intrude into the gap between the sliding contact 14 and the tubular conductor 15, because the piston rings 21 hermetically contact the tubular conductor 15. Also in FIG. 6, as the piston rings 21 slide on the inner surface 15*a* of the tubular conductor 15 along the axial direction of the piston 7, undesirable totterings of the moving arc-contact 8, the insulative rod 6 and the piston 7 in directions shown by arrows E and F, which correspond to the movement in directions shown by arrows A and B, can be prevented. As a result, the contact pressure of the sliding contact 14 to the tubular conductor 15 can be made uniform at any part thereof and the capacity of the sliding contact 14 can effectively be utilized.

In the closing operation of the contacts, the movable elements of the arc-extinction elements 4 in the direction shown by arrow A. And a circuit is closed by contacting of the current collectors 16 which serve as a main moving contact with the fixed contact 13.

In the above-mentioned second embodiment, the cross section of the piston ring 21 is rectangular, but a circular or a V-letter shaped ones can be adopted as they have the same or similar effect.

In the above-mentioned first and second embodiments, the insulation gas is sealed in the insulative tube 3 at a pressure of about 2–5 kgf/cm$^2$. Therefore, a stress $\sigma_r$ in radial direction and a stress $\sigma_\theta$ in circumferential direction corresponding to the pressure of on insulation gas always act to the insulative tube 3. Generally, the above-mentioned insulative tube 3 having inner tubular conductor 15 is manufactured by a cast molding process in a temperature range of 150°–200° C. When the insulative tube 3 is cooled to the normal temperature from the above-mentioned high temperature range, the insulative tube 3 is hardened and contracts, and the tubular conductor 15 also contracts in proportion to the temperature difference. Hereupon, when the thermal expansion coefficient of the tubular conductor 15 is larger than that of the insulative tube 3, the stress $\sigma_\theta$ in the circumferential direction of the insulative tube 3 is always in a compressive state (since, the stress $\sigma_\theta$ in the circumferential direction is generally larger than the stress $\sigma_r$ in radial direction).

When pressure of the insulation gas acts on the inner surface of the insulative tube 3 (the highest pressure part is in the lower space 9 where the insulation gas is compressed), the stress in the circumferential direction of the insulative tube 3 acts in effect as tension stress. However, the compression stress due to the thermal contraction has already acted on the insulative tube 3. Therefore, by selecting an insulative material such as epoxy resin and a conductive material such as aluminum which have larger thermal expansion coefficient than that of the insulative material, as materials of the insulative tube 3 and the tubular conductor 15 of the pressure vessel in accordance with the present invention, the above-mentioned compression stress and the tension stress may be canceled. Therefore, creep fracture of the insulative tube 3 or destruction of the insulative tube 3 due to the sudden pressure buildup at the time of breaking of the circuit can be prevented. Furthermore, the tubular conductor 15 receives abnormal high pressure of the insulation gas which may occur at accidental over-current breaking. Namely, the tubular conductor 15 serves as a reinforcement of the insulative tube 3 for partially relieving the internal stress of the insulative tube 3. As a result, the side wall of the insulative tube 3 can be made thin.

Figure 7:
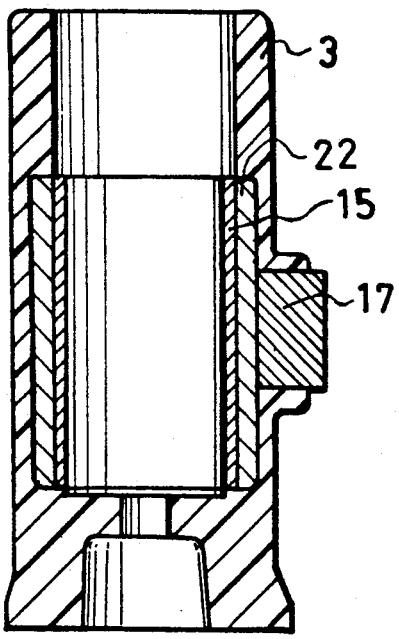
FIG. 7 is a cross-sectional view showing still another preferred embodiment of a pressure vessel in accordance with the present invention.
Figure 8:
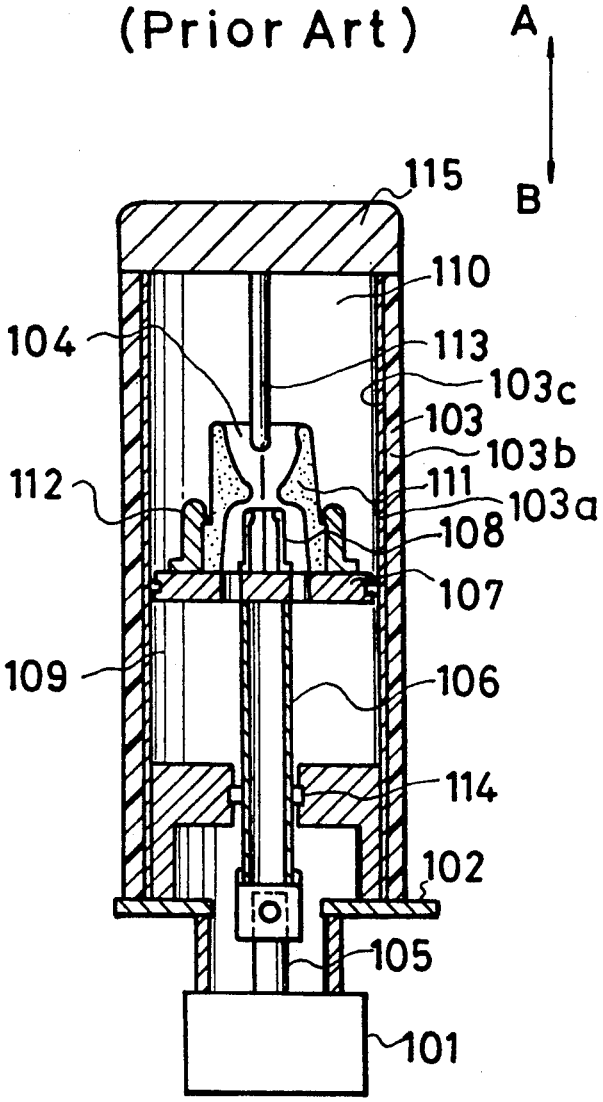
FIG. 8 (Prior Art)
FIG. 8 is a cross-sectional view showing a conventional arc-extinguisher and a conventional pressure vessel of a switch.

Another preferred embodiment of the pressure vessel in accordance with the present invention is described in reference to FIG. 7. In FIG. 7, a second tubular conductor 22 is provided co-axially with the outer surface of the tubular conductor 15. The second tubular conductor 22 is fixed to the tubular conductor 15 with electric conductivity thereto. Hereupon, as a material of the second tubular conductor 22, a conductive material having a larger thermal expansion coefficient than that of material of the insulative tube 3, and smaller than that of the conductive material of the tubular conductor 15 is suitable. Thereby, absolute values of the difference of the stresses acting on the insulative tube 3 and the second tubular conductor 22 or acting on the second tubular conductor 22 and the tubular conductor 15 can be reduced. Accordingly, pull-out-type fracture occurring at a boundary between the insulative tube 3 and the second tubular conductor 22 can be prevented.

In the above-mentioned embodiment, the insulative tube 3 for containing arc-extinction elements of a switch can be utilized for any type of pressure vessel made of resin.

Also, in the above-mentioned embodiment, the tubular conductor 15 is provided on peripheral part of the lower space 9 where the pressure of the insulation gas will be the highest. However, there is a case wherein the pressure of the insulation gas surrounding the arc-discharging part between the moving arc-contact 8 and the fixed contact 13 becomes the highest. Therefore, a constitution similar to the above-mentioned can be adopted thereto.

Furthermore, in the above-mentioned embodiments the insulative tube 3 is molded with the inserted tubular conductor 15. The tubular conductor 15, however, is not necessarily conductive when a method for collecting electric current similar to the prior art for collecting the electric current from the midway portion of the piston rod 6 is adopted.

Although the invention has been described in its preferred form with a certain degree of particularity, it is understood that the present disclosure of the preferred form, changes in the details of construction and the combination and arrangement of parts may be resorted to without departing from the spirit and the scope of the invention as hereinafter claimed.

What is claimed is:

1. An arc-extinguisher of a switch comprising:

an insulative tube for sealing an insulation gas in an inner space therein and having at least a conductive part on an inner surface thereof, said conductive part being connected to an electric circuit;

a rod shaped fixed contact provided on an end part of said inner space of said insulative tube and connected to said electric circuit;

a tubular moving arc-contact arranged coaxially with said fixed contact for discharging an arc between said moving arc-contact and said fixed contact when said moving arc-contact breaks contact with said fixed contact;

a main moving contact having tubular shape and disposed circularly around said moving arc-contact for conducting electric current of said electric circuit when said main moving contact contacts said fixed contact;

a piston whereon said main moving contact and said moving arc-contact are mounted, having at least one through-hole and reciprocally moving in said inner space of said insulative tube for making and breaking contact between said main moving contact and said moving arc-contact, and for compressing and expanding said insulation gas in said insulative tube, thereby extinguishing said arc discharged between said fixed contact and said moving arc-contact using insulation gas blown through said through-hole; and a cylindrical sliding contact provided on an outer peripheral surface of said piston and sliding on said conductive part of said insulative tube for electrically connecting said main moving contact and said moving arc-contact to said conductive part of said insulative tube.

2. An arc-extinguisher of a switch in accordance with claim 1, further comprising:

at least a pair of piston rings disposed on both end parts of said piston in a moving direction thereof and substantially surrounding a periphery of said cylindrical surface, for sealing a gap between said piston and said insulative tube.

3. A pressure vessel of a switch comprising:

an insulative tube serving as a tank for containing a fixed contact and a moving contact of a switch and sealing an insulation gas therein; and a reinforcement having higher rigidity and a higher thermal expansion coefficient than that of said insulative tube and closely fixed on an inner surface of said insulative tube for enclosing said fixed contact and said moving contact.

4. A pressure vessel of a switch in accordance with claim 3, wherein said reinforcement has conductivity for serving as an element of said switch.

* * * * *